United States Patent [19]

Shrock et al.

[11] Patent Number: 4,654,902

[45] Date of Patent: Apr. 7, 1987

[54] CONVERTIBLE SEAT-BED

[76] Inventors: Fred J. Shrock; Rex D. Hall, both of 28531 Jami Dr., Elkhart, Ind. 46515

[21] Appl. No.: 847,756

[22] Filed: Apr. 3, 1986

[51] Int. Cl.[4] ..... A47C 12/04

[52] U.S. Cl. ..... 5/37 R; 5/41; 5/48

[58] Field of Search ..... 5/17, 37 R–37 C, 5/41, 47, 48; 297/322

[56] References Cited

U.S. PATENT DOCUMENTS 2,352,375 6/1944 Fox ..... 5/47
2,738,520 3/1956 Murphy et al. ..... 5/47
3,657,747 4/1972 Rogers, Jr. et al. ..... 5/37 R
4,104,747 8/1978 Bell et al. ..... 5/47
4,204,288 5/1980 Villa et al. ..... 5/47

FOREIGN PATENT DOCUMENTS 313520 4/1956 Switzerland ..... 5/37 R

*Primary Examiner*—Gary L. Smith
*Assistant Examiner*—Michael F. Trettel

[57] ABSTRACT

A convertible seat-bed includes a pair of plates pivotally connected to the seat support and back support of the seat-bed. An arm is pivotally connected between the pivot plates and acts as a control link.

2 Claims, 5 Drawing Figures

CONVERTIBLE SEAT-BED

SUMMARY OF THE INVENTION

This invention relates to a convertible seat bed and will have special but not limited application to a seat-bed used in a van or other recreational vehicle.

Convertible seat-beds often include seat and back supports connected to pivot links. Previously, these seat-beds required clearance of the back support from a wall to permit conversion between bed and seat positions. Also, the construction of the pivot links allowed accidental insertion of fingers which often caused serious injury.

The seat-bed of this invention includes pivot plates attached to the seat and back supports. An arm pivotally connects the plates. This construction allows the seat-bed to be shifted into a bed position with little or no rear clearance and provides no gaps into which a user could accidentally insert his fingers.

Accordingly, it is an object of this invention to provide for an improved convertible seat-bed.

Another object of this invention is to provide for a convertible seat-bed which is safe, reliable and economical.

Another object of this invention is to provide for a convertible seat-bed which requires minimal clearance when shifting the seat-bed between various positions.

Another object of this invention is to provide a novel convertible seat-bed which is for use in recreational vehicles and the like. Other objects of this invention will become apparent upon a reading of the following description.

BRIEF DESCRIPTION OF THE DRAWING

A preferred embodiment of the invention has been depicted for illustrative purposes wherein.

DESCRIPTION OF THE PREFERRED EMBODIMENT

Figure 1:
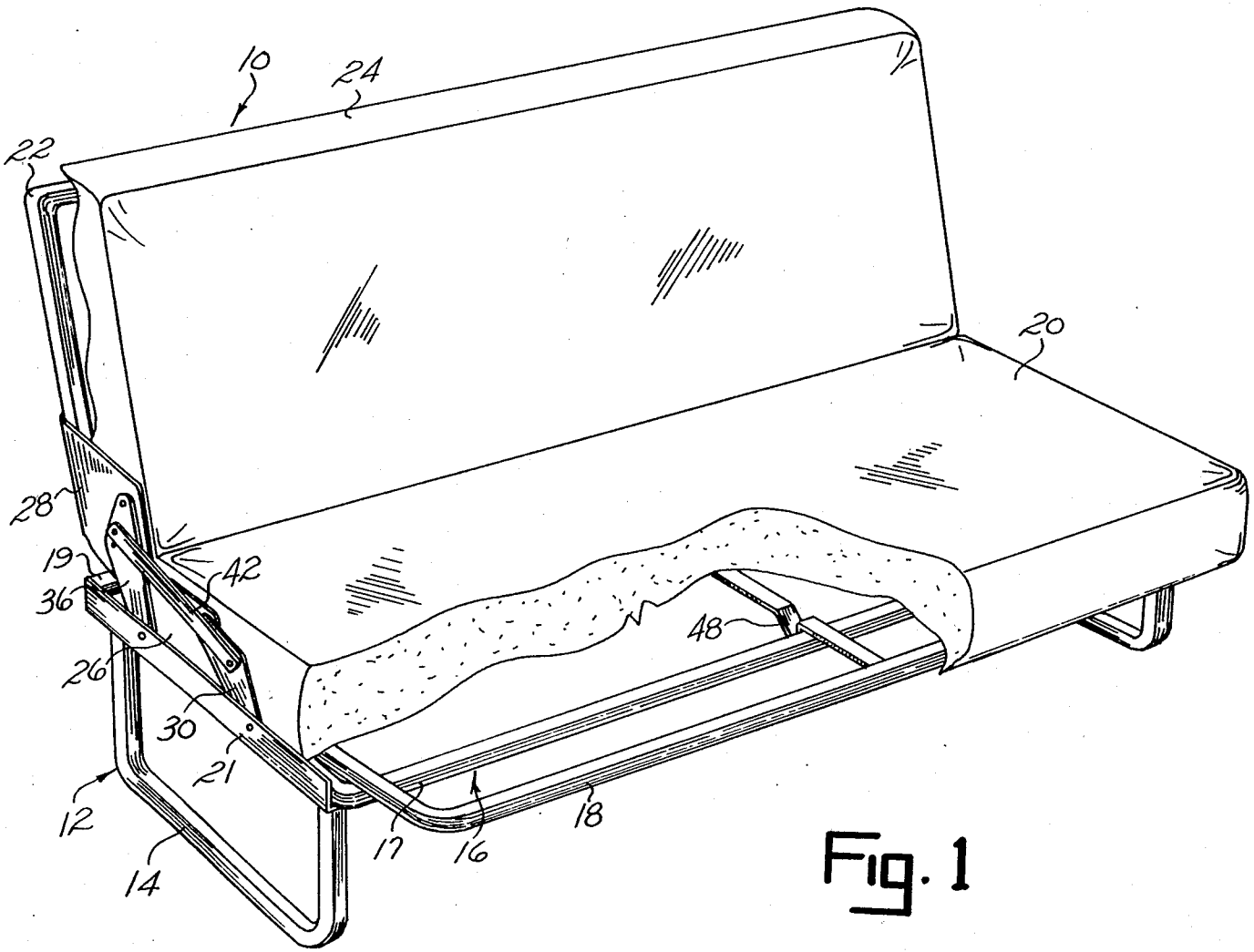
FIG. 1 is a perspective view of the seat-bed in the seat position with portions broken away for illustrative purposes.
Figure 2:
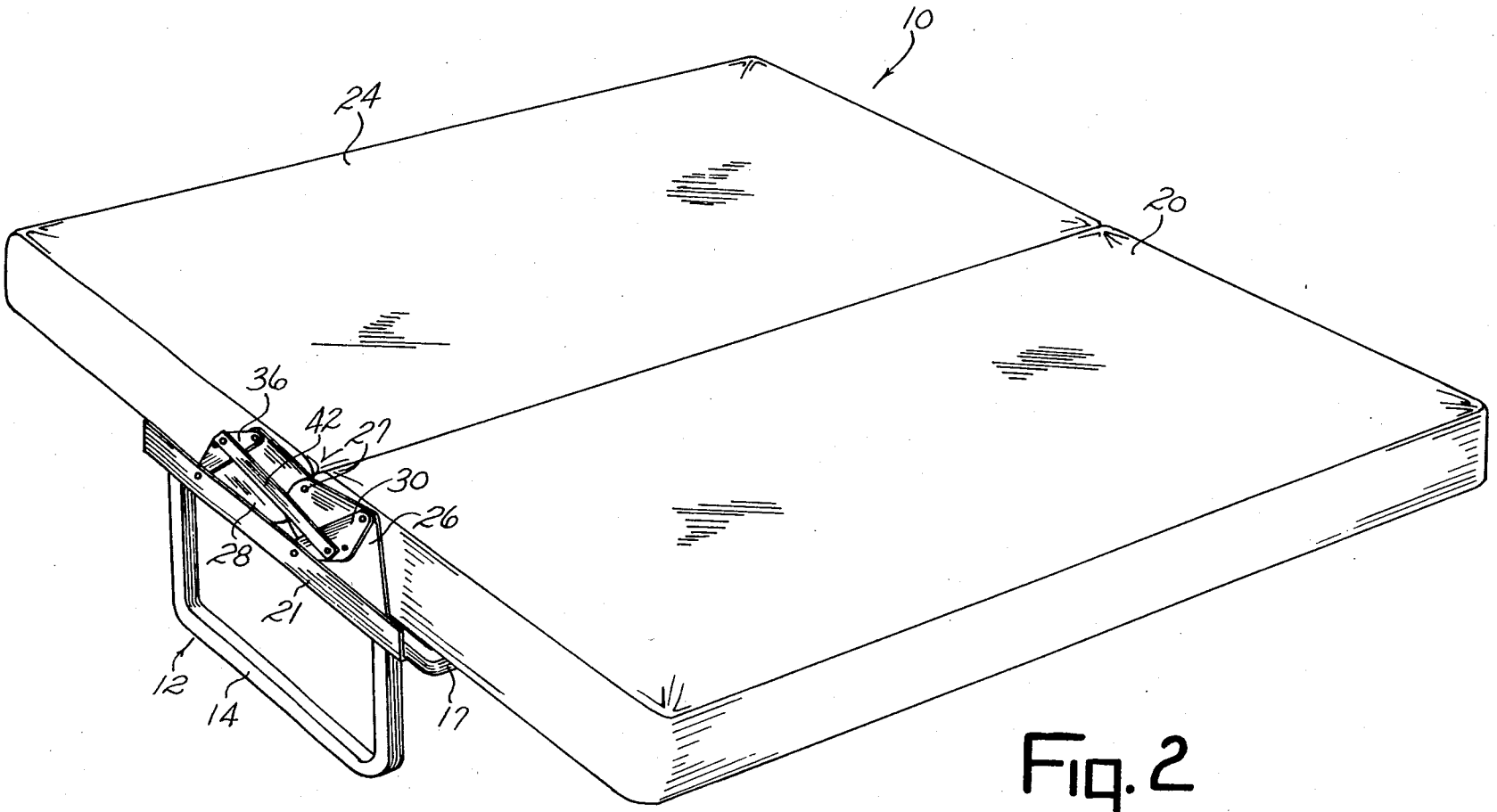
FIG. 2 is a perspective view of the seat-bed in the bed position.

The preferred embodiment herein described is not intended to be exhausitve or to limit the invention to the precise form disclosed. It is chosen and described to explain the principles of the invention and its application and practical use to thereby enable others skilled in the art to utilize the invention.

The seat-bed 10 shown in the drawings includes a support frame 12 which has spaced upright U-shaped supports 14 connected by a horizontal rectangular frame member 16. Frame member 16 includes a front frame part 17, a rear frame part 19, and side frame parts 21. A seat support 18 carries a seat cushion 20 and is supported upon frame member 16. A back support 22 carries a back cushion 24 as shown. Seat support 18 is connected to back support 22 by a pivot mechanism 25 located at each side of the seat-bed frame 12.

Each pivot mechanism 25 includes a mounting plate 26 secured to the rear of seat support 18 by bolts 29 and a mounting plate 28 secured to the lower end of back support 22 by bolts 31. Mounting plates 26, 28 are secured to one another by pivot bolt 27.

A pivot plate 30 is connected at one end to seat support mounting plate 26 by a fastener 32 and at its other end to frame part 16 by a pivot pin 34. A pivot plate 36 is connected at one end to back support mounting plate 28 by fastener 38 and at its other end to frame part 16 by pivot pin 40. A pivot arm 42 is connected to pivot plate 30 between its ends by fastener 44 and to pivot plate 36 between its ends by fastener 46. Seat support 18 includes a detent part 48.

Figure 3:
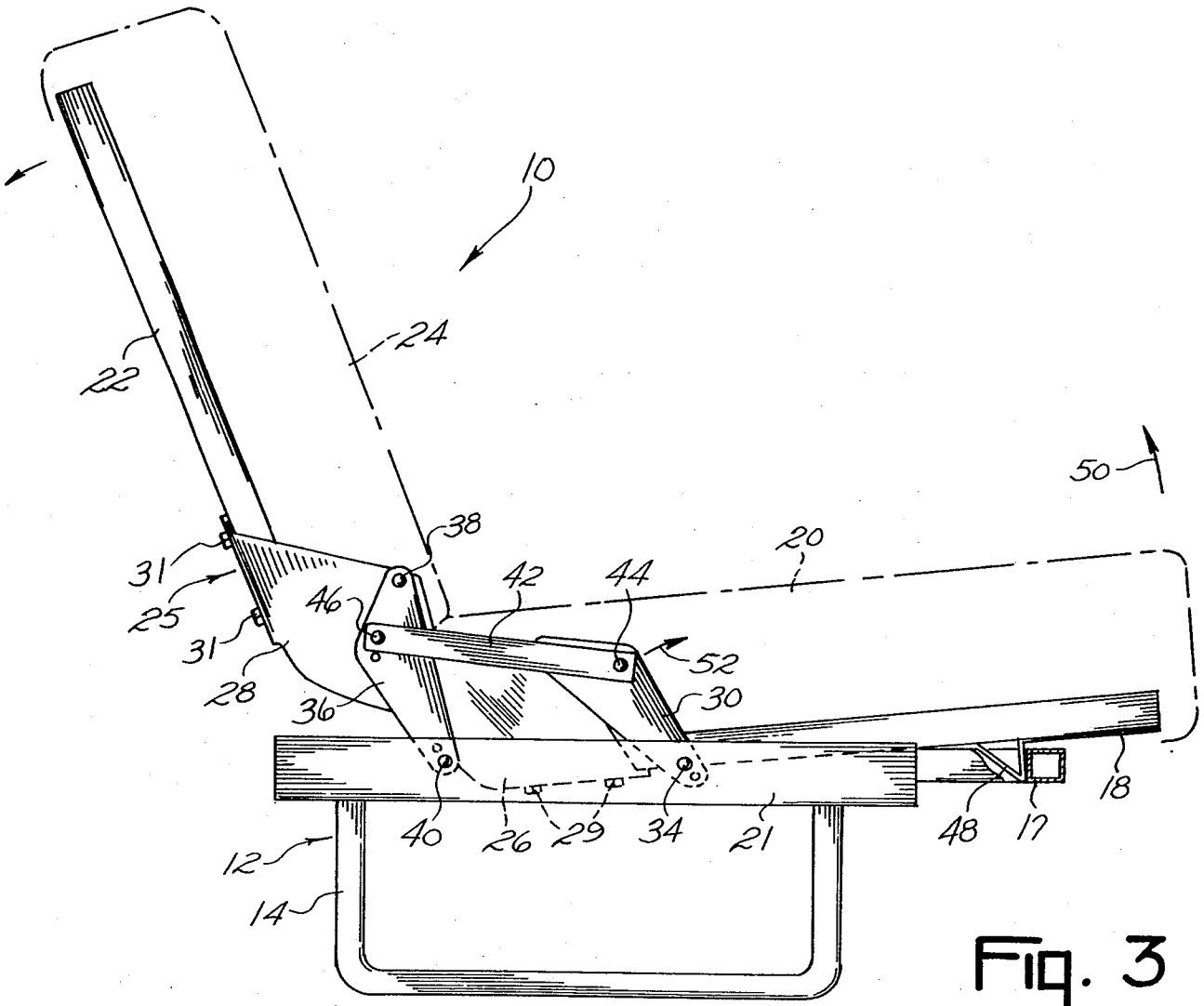
FIG. 3 is a side elevational view of the frame of the seat-bed in the seat position with portions shown in section and the cushions shown in broken lines for purposes of illustration.
Figure 4:
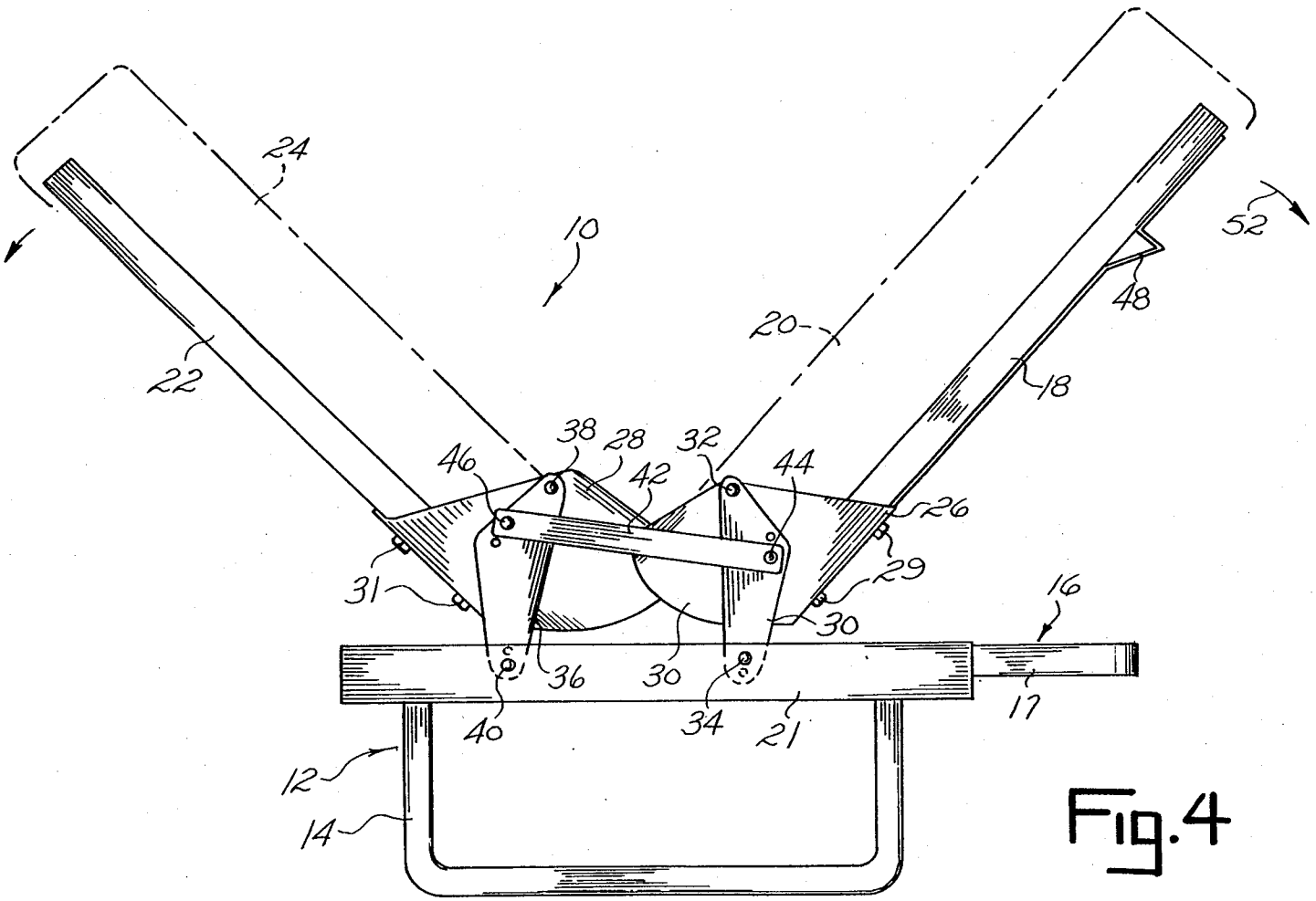
FIG. 4 is a side elevational view of the frame of the seat-bed in an intermediate position.
Figure 5:
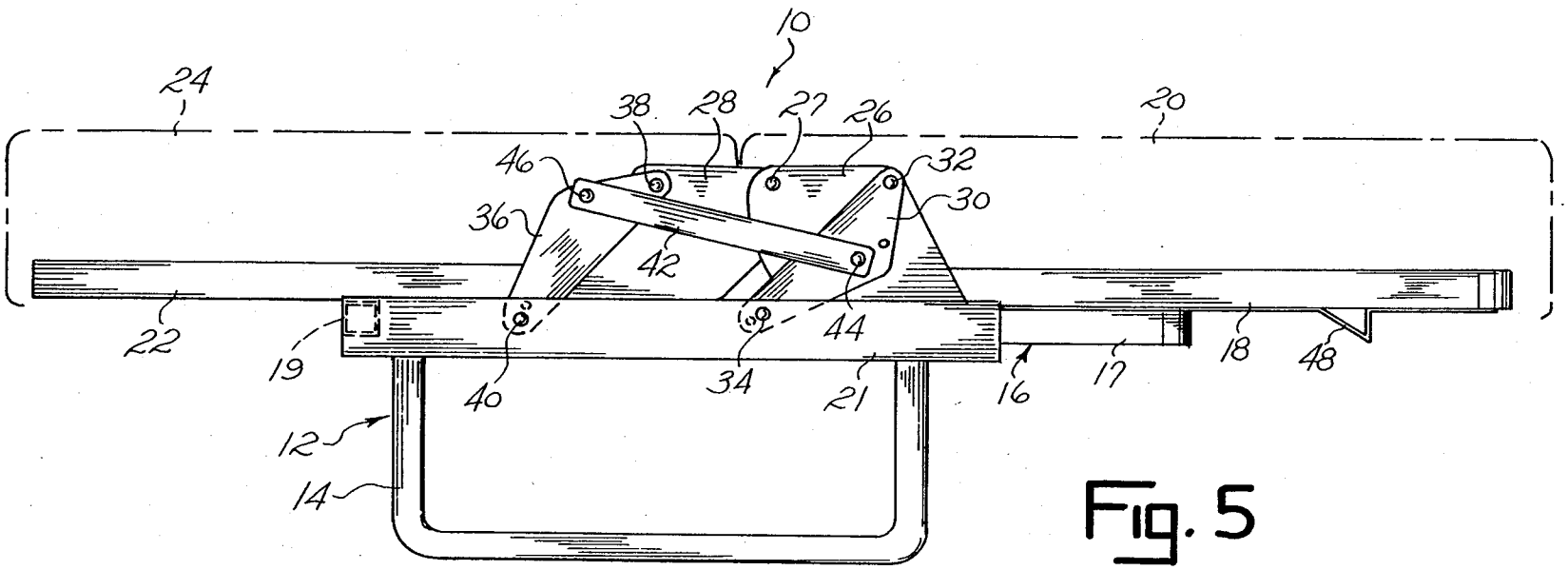
FIG. 5 is a side elevational view of the frame of the seat-bed in a bed position.

FIGS. 3–5 depict the conversion of seat-bed 10 from its seat position (FIG. 3) into its bed position (FIG. 5). With seat-bed 10 in the seat position of FIGS. 1 and 3, detent part 48 compressively engages front frame member 16 to secure the seat-bed against undesired shifting of the bed into its bed position. To convert the seat-bed 10 into the bed position, a person lifts seat support 18 in the direction of arrow 50 to disengage detent part 48 from front frame member 16. Seat support 18 is then pulled forwardly of frame member 16 to cause pivot plate 30 to be shifted along arm 42 in the direction of arrow 52 (FIG. 3) until the seat-bed is in the bed position of FIG. 5. To return seat-bed 10 to its seat position, one simply lifts up on back support 22 to shift pivot plates 30, 36 back to the position of FIG. 3. Seat support 18 is then pushed downwardly until detent part 48 compressively engages frame member 16 to lock the seat support in the seat position.

It is understood that the above description does not limit the invention to the precise given details but may be modified within the scope of the appended claims.

We claim:

1. In a convertible seat-bed including a floor supportable frame, a seat support for supporting a seat cushion, and a back support for supporting a back cushion, pivot means connecting said seat support and said back support to said frame for allowing movement of said seat and back supports between a seat position wherein said back support is generally upright and the seat support generally horizontal, and a bed position wherein said seat and back supports are generally horizontal, the improvement wherein said seat support and back support each include a mounting plate, said pivot means includes a first pivot plate pivotally connected at one end to said back support mounting plate and at an end opposite said one end to said support frame, a second pivot plate pivotally connected at one end to said seat support mounting plate and at an end opposite said second pivot plate one end to said support frame, said mounting plates being pivoted together at a location spaced from said first and second pivot plate connections to the mounting plates, and an arm pivotally connected between said first and second pivot plates.

2. The seat bed of claim 1 wherein said support frame includes a horizontal rail member, said seat support including a detent part which compressively contacts said support frame horizontal rail member when in the seat position to secure said seat-bed in its said seat position.

* * * * *